US009172186B2

(12) United States Patent
Chen et al.

(10) Patent No.: US 9,172,186 B2
(45) Date of Patent: Oct. 27, 2015

(54) ANTI-MISINSERTION STRUCTURE OF SOCKET CONNECTOR

(71) Applicants: Mark Chen, New Taipei (TW); Kevin Liu, New Taipei (TW)

(72) Inventors: Mark Chen, New Taipei (TW); Kevin Liu, New Taipei (TW)

(73) Assignee: T-Conn Precision Corporation, Taipei (TW)

( * ) Notice: Subject to any disclaimer, the term of this patent is extended or adjusted under 35 U.S.C. 154(b) by 389 days.

(21) Appl. No.: 13/657,866

(22) Filed: Oct. 23, 2012

(65) Prior Publication Data

US 2013/0171862 A1 Jul. 4, 2013

(30) Foreign Application Priority Data

Dec. 29, 2011 (TW) ..... 100224876 U

(51) Int. Cl.
*H01R 13/64* (2006.01)
*H01R 13/642* (2006.01)

(52) U.S. Cl.
CPC ..... *H01R 13/64* (2013.01); *H01R 13/642* (2013.01)

(58) Field of Classification Search
CPC .... H01R 13/64; H01R 13/642; H01R 13/629; H01R 23/7073; H01R 23/025
USPC ..... 439/677, 676, 374
See application file for complete search history.

(56) References Cited

U.S. PATENT DOCUMENTS

| | | | | |
|---|---|---|---|---|
| 6,273,761 | B1 * | 8/2001 | Hsu et al. | 439/676 |
| 6,283,796 | B1 * | 9/2001 | Yeh | 439/677 |
| 6,296,528 | B1 * | 10/2001 | Roberts et al. | 439/676 |
| 6,312,293 | B1 * | 11/2001 | Wang | 439/677 |
| 6,319,070 | B1 * | 11/2001 | Tan | 439/680 |
| 6,350,156 | B1 * | 2/2002 | Hasircoglu et al. | 439/676 |
| 6,431,919 | B1 * | 8/2002 | Wang et al. | 439/680 |
| 6,458,001 | B1 * | 10/2002 | Chen et al. | 439/680 |
| 6,808,427 | B1 * | 10/2004 | Xue | 439/676 |
| 6,918,794 | B2 * | 7/2005 | Wan et al. | 439/676 |
| 6,918,795 | B2 * | 7/2005 | Xue | 439/676 |
| 6,957,984 | B1 * | 10/2005 | Huang | 439/676 |
| 6,966,798 | B1 * | 11/2005 | Wu | 439/677 |
| 7,037,141 | B1 * | 5/2006 | Huang | 439/676 |
| 7,708,602 | B2 * | 5/2010 | Rascon et al. | 439/676 |
| 2003/0157843 | A1 * | 8/2003 | Thomas | 439/680 |
| 2004/0224565 | A1 * | 11/2004 | Wan et al. | 439/680 |
| 2004/0235358 | A1 * | 11/2004 | Wan et al. | 439/676 |
| 2005/0070168 | A1 * | 3/2005 | Xue | 439/676 |

* cited by examiner

*Primary Examiner* — Abdullah Riyami
*Assistant Examiner* — Vladimir Imas

(57) ABSTRACT

An anti-misinsertion structure of a socket connector includes a pivot clasped to both sides of the top of an insulating base of the socket connector and two connecting arms extended horizontally from both sides of the pivot. Each connecting arm has a guide piece extended horizontally from an end of each connecting arm, a stop piece formed at the bottom of the connecting arm and proximate to the guide piece of the connecting arm, a downwardly tilted first guide bevel formed at the bottom of the guide piece, a position limit surface defined on a side of the guide piece and proximate to the stop piece, an upwardly tilted second guide bevel formed at the bottom of the stop piece, and a stop surface defined on a side of the stop piece and proximate to the guide piece and perpendicular to the position limit surface of the guide piece.

10 Claims, 13 Drawing Sheets

ANTI-MISINSERTION STRUCTURE OF SOCKET CONNECTOR

FIELD OF THE INVENTION

The present invention relates to a socket connector, in particular to an anti-misinsertion structure of the socket connector having a pivot and two connecting arms extended horizontally from both sides of the pivot for preventing plug connectors of similar or different specifications from being plugged in a docking space.

BACKGROUND OF THE INVENTION

As computer technology advances, users can connect to the internet through a computer to obtain network information or transmit documents, and thus the internet has become one of the necessary resources required by individuals or companies in our daily life. In view of the development of the aforementioned network technologies, a socket connector of a computer host is provided for installing and connecting a network plug connector, and the socket connector of the network is mainly divided into two types, respectively: Registered Jack-11 (RJ-11) plug connector generally used as a connector for connecting a telephone line to a modem, so that the computer can perform network operations through the modem and the telephone line; and Registered Jack-45 (RJ-45) plug connector generally used in an UTP local area network system.

However, the RJ-11 plug connector and the RJ-45 plug connector have similar appearances and different specifications, wherein the RJ-45 plug connector is slightly larger than the RJ-11 plug connector and users often misidentify them or plug the smaller RJ-11 plug connector into the RJ-45 connector, so that conductive terminals of the RJ-45 plug connector are improperly compressed by the R-11 plug and deformed. As a result, the plug connector cannot be used anymore.

In view of the aforementioned problem, the inventor of the present invention provides a socket connector using the guide piece of the socket connector to guide the default RJ-45 plug connector to be inserted into the docking space by the structural design of the anti-misinsertion component and the combination of the insulating base and the shielding casing, and the stop piece of the socket connector can prevent an insertion of a non-adaptive RJ-11 plug connector to prevent a plug connection of a different specification from being inserted into the docking space, so as to achieve the effects of preventing a mis-insertion of a non-adaptive plug and protecting conductive terminals of the socket connector.

SUMMARY OF THE INVENTION

In view of the aforementioned problems, the present invention is directed to a socket connector for preventing a misinsertion of a non-adaptive plug connector.

The present invention is directed to a socket connector capable of guiding the insertion of a default plug connector and preventing the insertion of non-adaptive plug connectors.

To accordance with the foregoing, the present invention provides a socket connector comprising: an insulating base, an anti-misinsertion component accommodated in a clasp slot of the insulating base, and a shielding casing covered onto the external periphery of the insulating base, wherein the insulating base has a docking space for inserting a plug connector, a plurality of conductive terminals installed in the docking space, and a clasp slot formed on both sides of the top of the insulating base and interconnected to the docking space; the anti-misinsertion component has a pivot and two connecting arms extended respectively and horizontally from both sides of the pivot, wherein the connecting arms have a guide piece extended horizontally from an end of the connecting arms, the connecting arm, and a stop piece formed at the bottom of each of the connecting arms and proximate to the guide piece of the connecting arm; the shielding casing has a plug hole formed at a position opposite to the docking space of the insulating base, and an elastic plate installed separately on both sides of the top of the shielding casing, and the elastic plate of the shielding casing abuts a recessed portion of the anti-misinsertion component.

In the socket connector of the present invention, the clasp slot of the insulating base has a stop block disposed therein, and the stop block is stopped at an end of the connecting arm of the anti-misinsertion component and proximate to the pivot.

In the socket connector of the present invention, the clasp slot of the insulating base has a clasp hole formed therein for clasping the pivot of the anti-misinsertion component.

In the socket connector of the present invention, the insulating base has a narrow groove formed separately on two sidewalls of the insulating base for containing a light emitting diode.

In the socket connector of the present invention, the guide piece of the anti-misinsertion component has a downwardly tilted first guide bevel defined on a bottom surface of the guide piece.

In the socket connector of the present invention, the guide piece of the anti-misinsertion component has a position limit surface defined on a side of the anti-misinsertion component and proximate to the stop piece, and the position limit surface and the stop piece are perpendicular to each other.

In the socket connector of the present invention, the stop piece of the anti-misinsertion component has an upwardly tilted second guide bevel defined on a bottom surface of the stop piece.

In the socket connector of the present invention, the stop piece of the anti-misinsertion component has a stop surface defined at a side of the stop piece and proximate to the guide piece, and the stop surface and the guide piece are perpendicular to each other.

In the socket connector of the present invention, the connecting arm of the anti-misinsertion component has a recessed portion formed at the top of the connecting arm, and the recessed portion has an abutment bevel formed at an end of the recessed portion and proximate to the stop piece, and the abutment bevel is provided for abutting the elastic plate of the shielding casing.

In the socket connector of the present invention, the connecting arm of the anti-misinsertion component has a protruding block formed at a bottom surface of the connecting arm and proximate to the pivot.

In the socket connector of the present invention, the anti-misinsertion component is made of plastic or metal.

In the present invention, the pivot of the anti-misinsertion component, the guide bevel of the two connecting arms and the stop surface guide a default plug connector into the socket connector and prevent an insertion of a non-adaptive plug connector, so as to achieve the effects of preventing a misinsertion of a non-adaptive plug connector and protecting the conductive terminals of the socket connector.

DESCRIPTION OF THE PREFERRED EMBODIMENTS

The technical characteristics of the present invention will become apparent with the detailed description of the preferred embodiments accompanied with the illustration of related drawings as follows.

Figure 1:
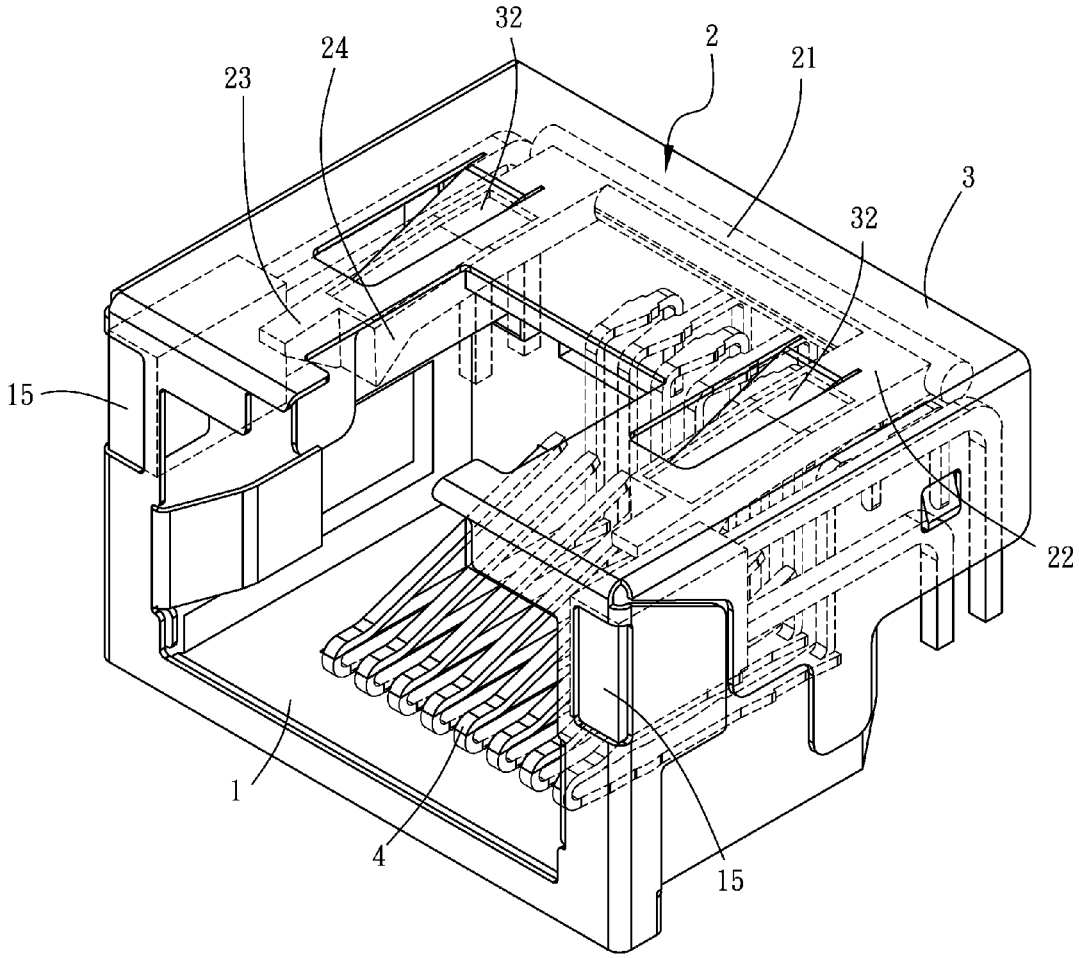
FIG. 1 is a perspective view of a preferred embodiment of the present invention.
Figure 2:
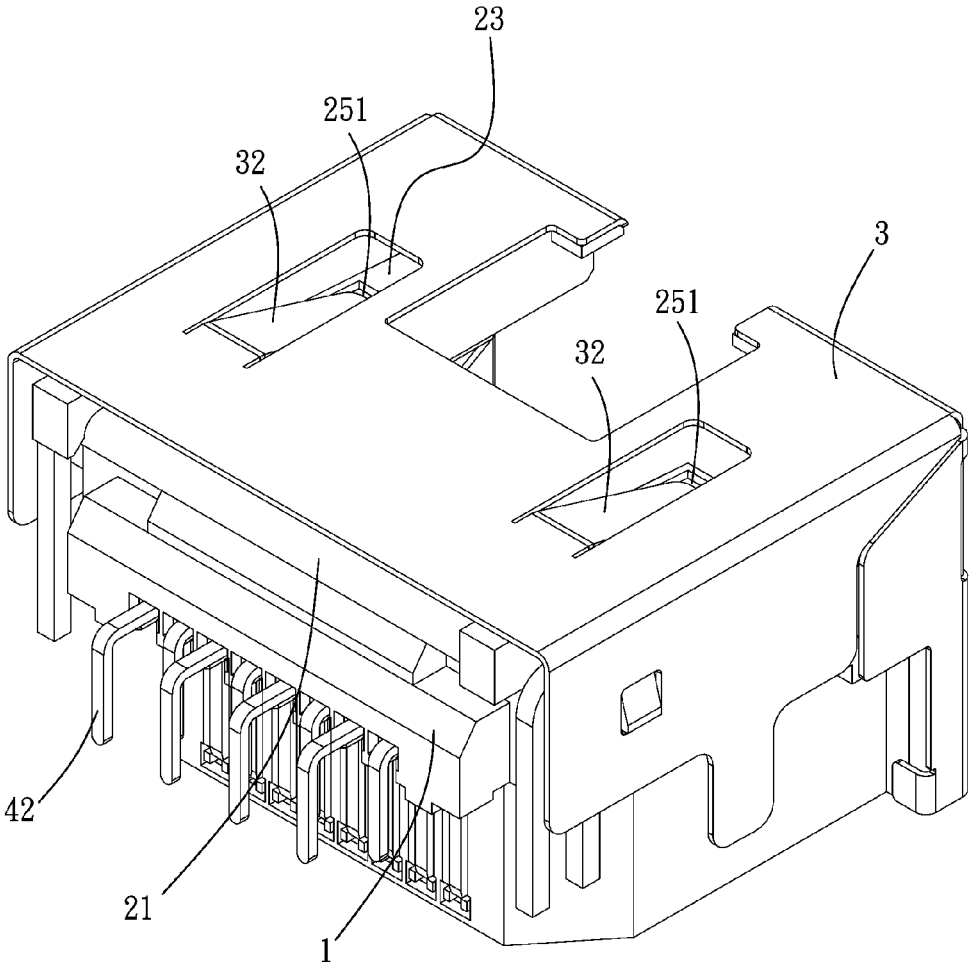
FIG. 2 is another perspective view of a preferred embodiment of the present invention, viewing from a different angle.
Figure 3:
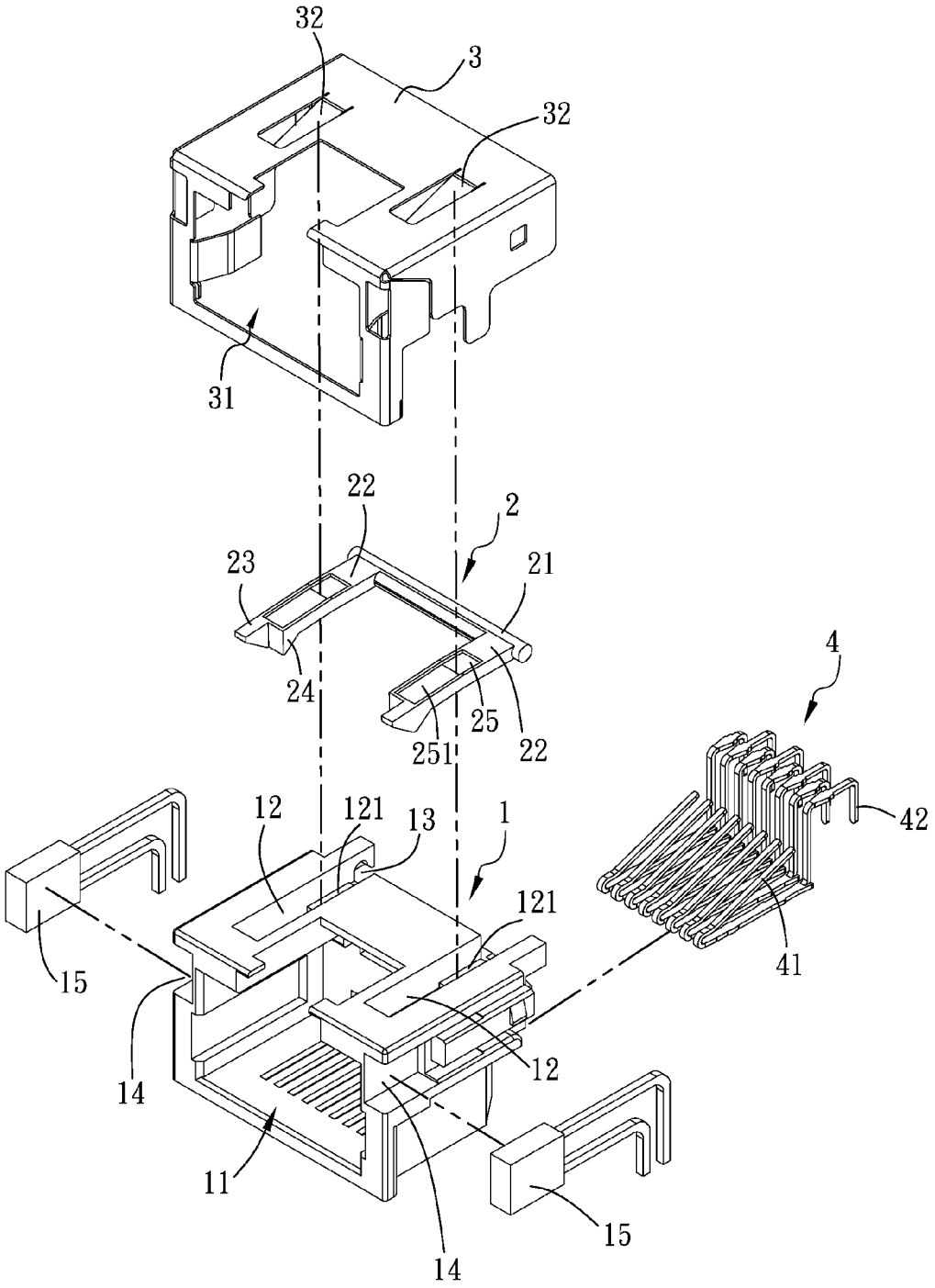
FIG. 3 is an exploded view of a preferred embodiment of the present invention.
Figure 4:
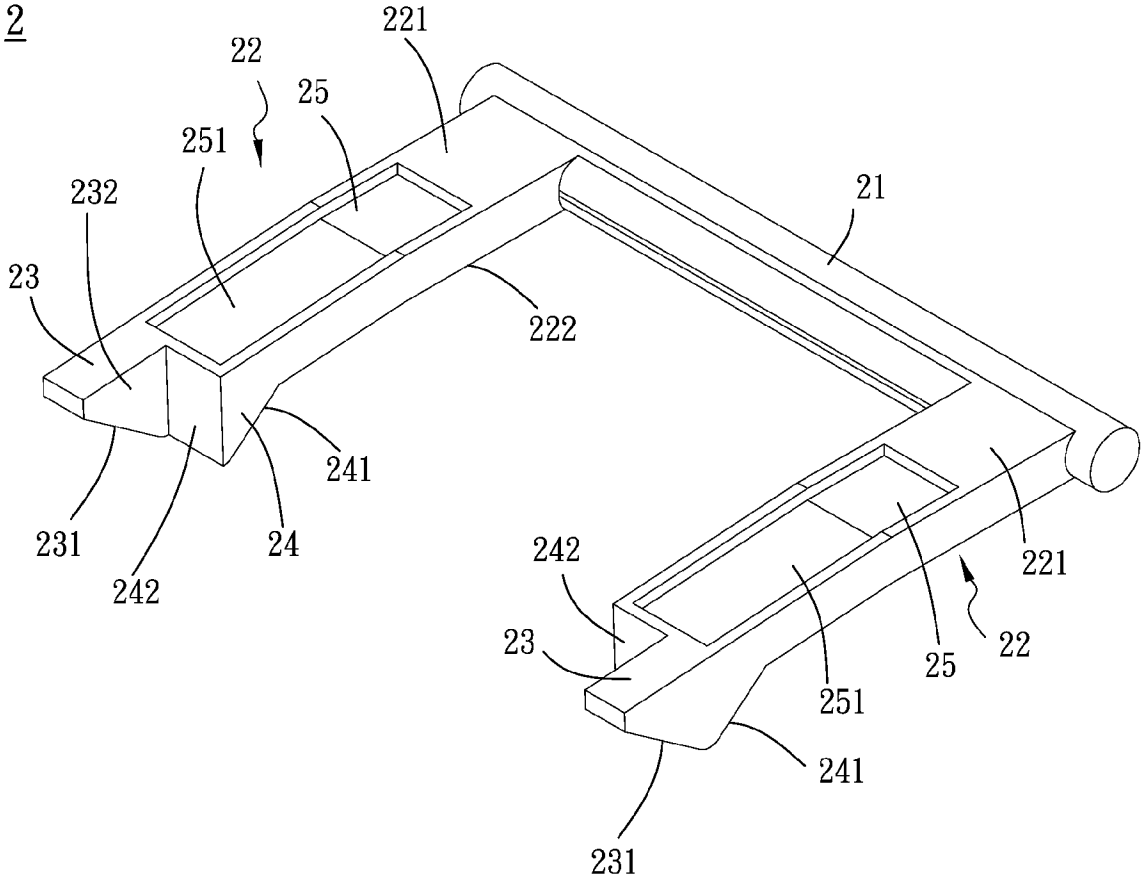
FIG. 4 is a perspective view of an anti-misinsertion component of a preferred embodiment of the present invention.
Figure 4A:
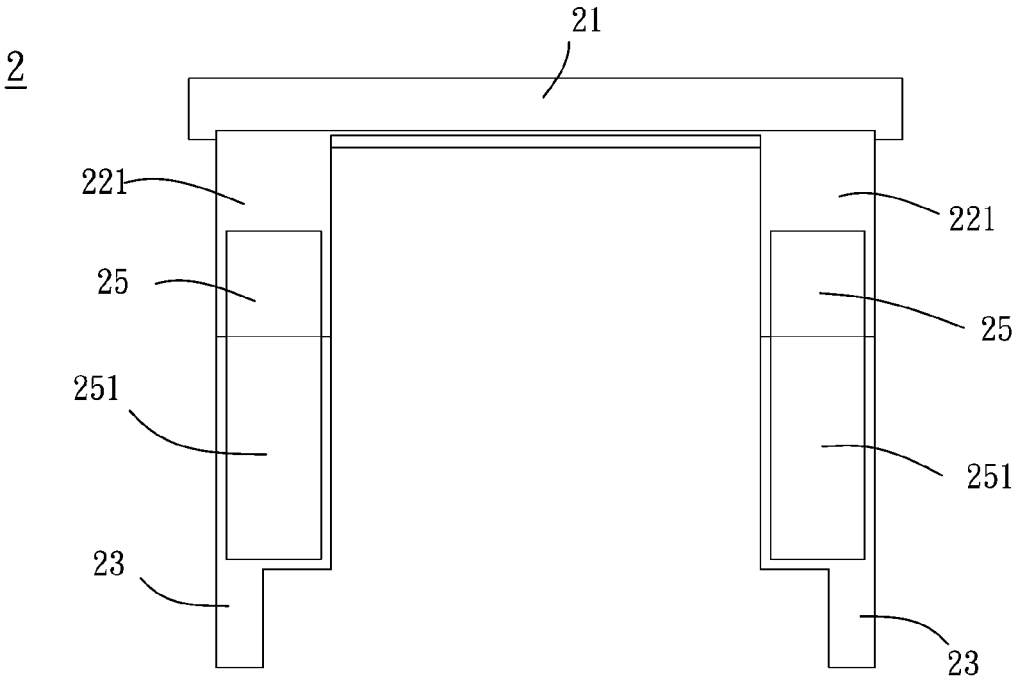
FIG. 4A is a top view of an anti-misinsertion component of a preferred embodiment of the present invention.
Figure 4B:
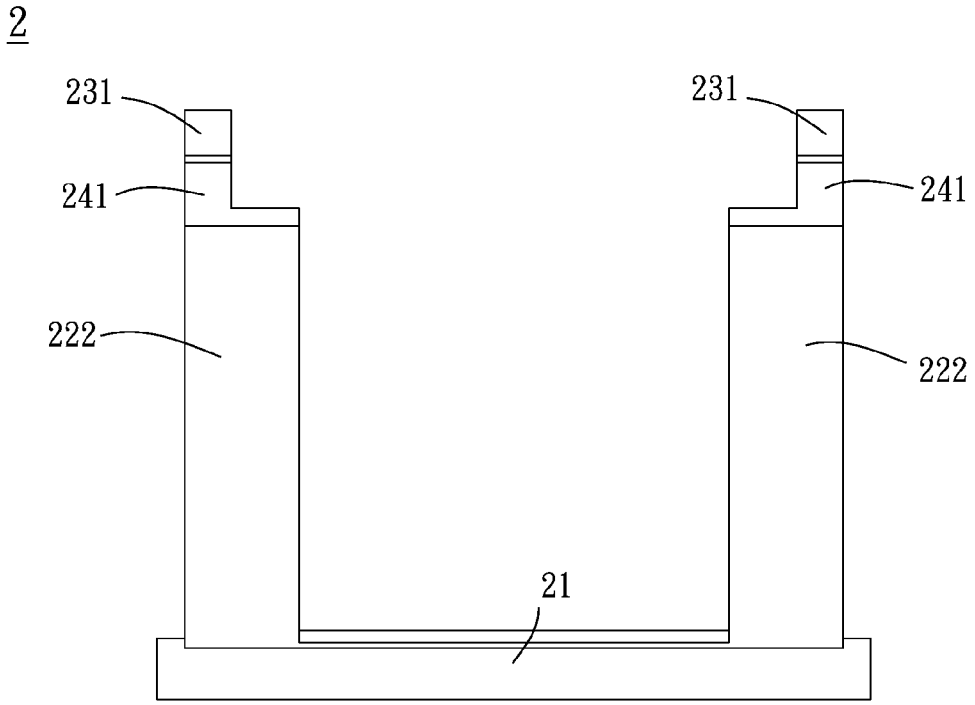
FIG. 4B is a bottom view of an anti-misinsertion component of a preferred embodiment of the present invention.
Figure 4C:
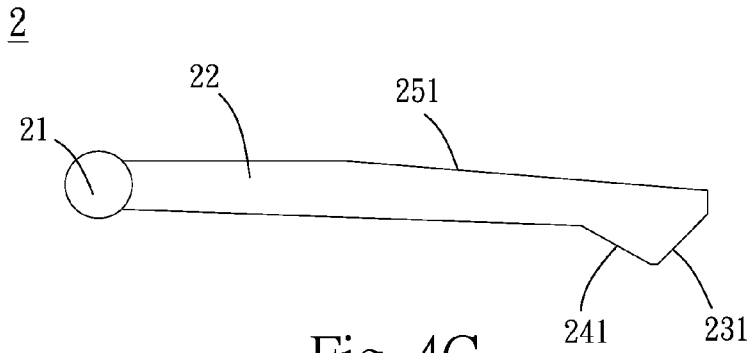
FIG. 4C is a left side view of an anti-misinsertion component of a preferred embodiment of the present invention.
Figure 4D:
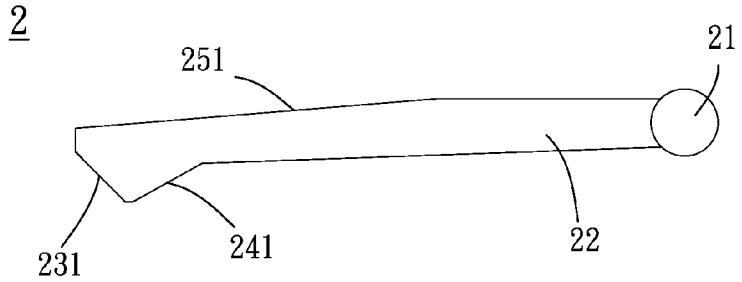
FIG. 4D is a right side view of an anti-misinsertion component of a preferred embodiment of the present invention.
Figure 4E:
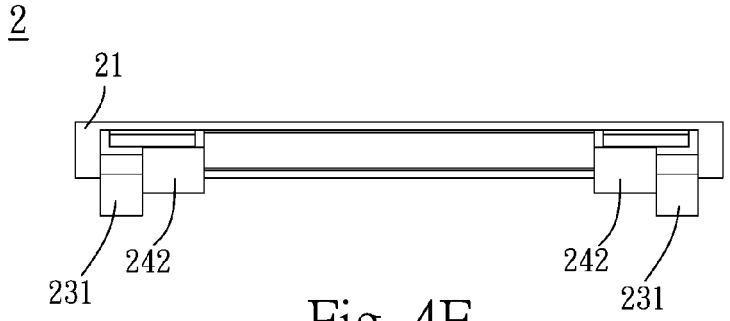
FIG. 4E is a front view of an anti-misinsertion component of a preferred embodiment of the present invention.
Figure 4F:
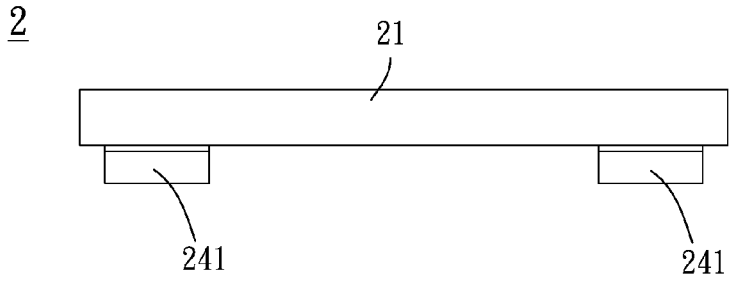
FIG. 4F is a rear view of an anti-misinsertion component of a preferred embodiment of the present invention.

With reference to FIGS. 1 to 3 for perspective views, another perspective view and an exploded view of a socket connector in accordance with a preferred embodiment of the present invention, the socket connector comprises an insulating base 1, an anti-misinsertion component 2 and a shielding casing 3, wherein the insulating base 1 has a docking space 11 for inserting a plug connector 5, 6, and the docking space 11 contains a plurality of conductive terminals 4 installed therein, and a clasp slot 12 is formed separately on both sides of the top of the insulating base 1 and interconnected to the docking space 11, and a narrow groove 14 is formed separately on two sidewalls of the insulating base 1 for accommodating a light emitting diode 15.

Wherein, the conductive terminal 4 includes a contact portion 41 and a downwardly bent soldered tail portion 42, and the clasp slot 12 of the insulating base 1 includes a stop block 121 and a clasp hole 13 formed therein, and the stop block 121 is stopped at an end of the connecting arm 22 of the anti-misinsertion component 2 and proximate to a pivot 21, and the clasp hole 13 is provided for clasping the pivot 21 of the anti-misinsertion component 2.

With reference to FIGS. 4, and 4A to 4F, the anti-misinsertion component 2 is made of plastic or metal, and the anti-misinsertion component 2 includes a pivot 21 and two connecting arms 22 respectively and horizontally extended from both sides of the pivot 21, wherein a guide piece 23 is horizontally extended from an end of the connecting arms 22; a recessed portion 25 is formed at a top surface 221 of the connecting arm 22; an abutment bevel 251 is formed at an end of the recessed portion 25 and proximate to the stop piece 24; a stop piece 24 is disposed at the other end of the bottom surface 222 of the connecting arm 22 and proximate to the guide piece 23 of the connecting arm 22, and the guide piece 23 has a downwardly tilted first guide bevel 231 defined at the bottom surface of the guide piece 23; a position limit surface 232 is defined on a side of the guide piece 23 and proximate to the stop piece 24, and the stop piece 24 has an upwardly tilted second guide bevel 241 formed at the bottom surface of the stop piece 24, and a stop surface 242 formed at a side of the stop piece 24 and proximate to the guide piece 23, and the stop surface 242 and the position limit surface 232 of the guide piece 23 are perpendicular to each other.

Figure 5A:
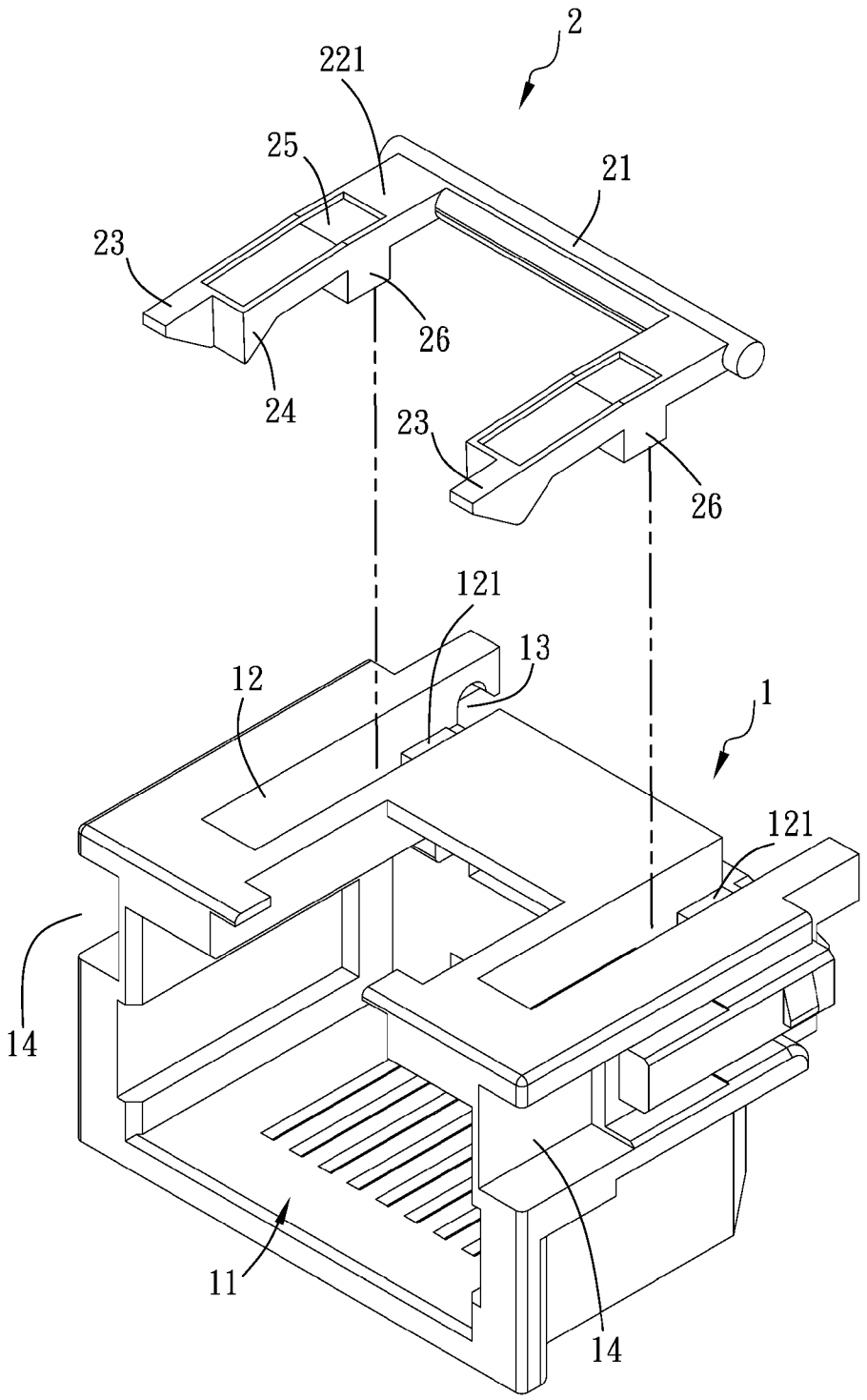
FIG. 5A is a perspective view of an anti-misinsertion component and an insulating base of another preferred embodiment of the present invention.
Figure 5B:
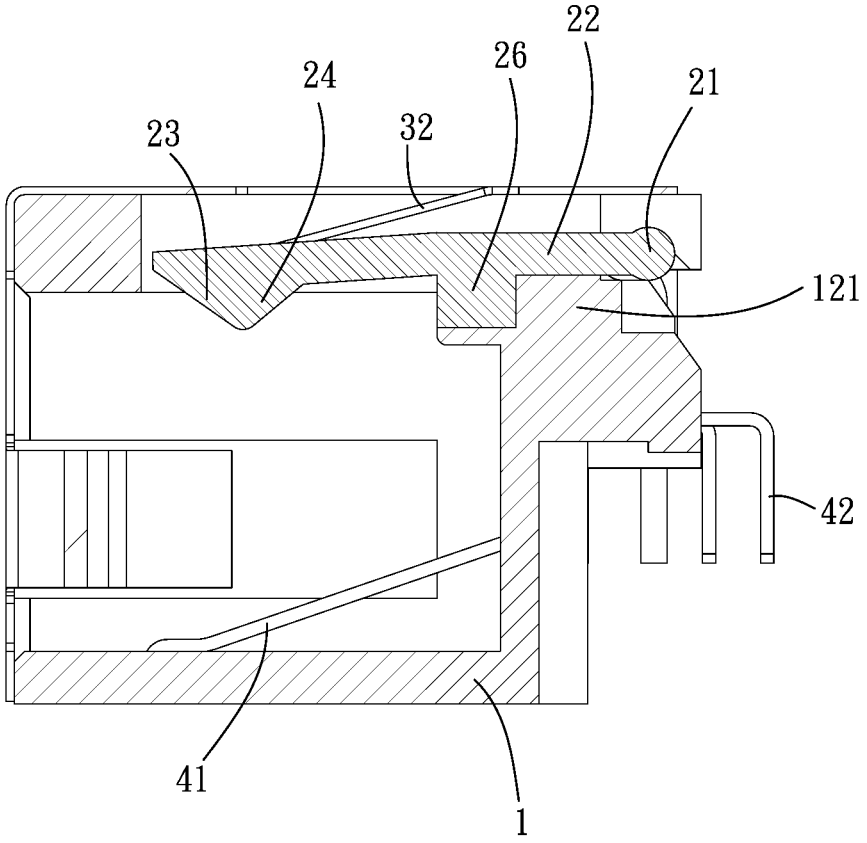
FIG. 5B is a cross-sectional side view of another preferred embodiment of the present invention.

With reference to FIG. 5A for an insulating base 1 and an anti-misinsertion component 2 in accordance with another preferred embodiment of the present invention, the anti-misinsertion component 2 comprises a pivot 21 and two connecting arms 22 respectively and horizontally extended from both sides of the pivot 21, wherein a guide piece 23 is horizontally extended from an end of the connecting arms 22; a stop piece 24 is disposed on the bottom surface 222 of the connecting arm 22 and proximate to the other end of the guide piece 23 of the connecting arm 22; the connecting arm has a protruding block 26 disposed on the bottom surface 222 and proximate to an end of the pivot 21. In FIG. 5B, the anti-misinsertion component 2 is provided for preventing the anti-misinsertion component 2 from being compressed by the plug connector 5, 6 or retracted by external forces by the design of abutting the protruding block 26 against the stop block 121 of the insulating base 1.

Figure 6:
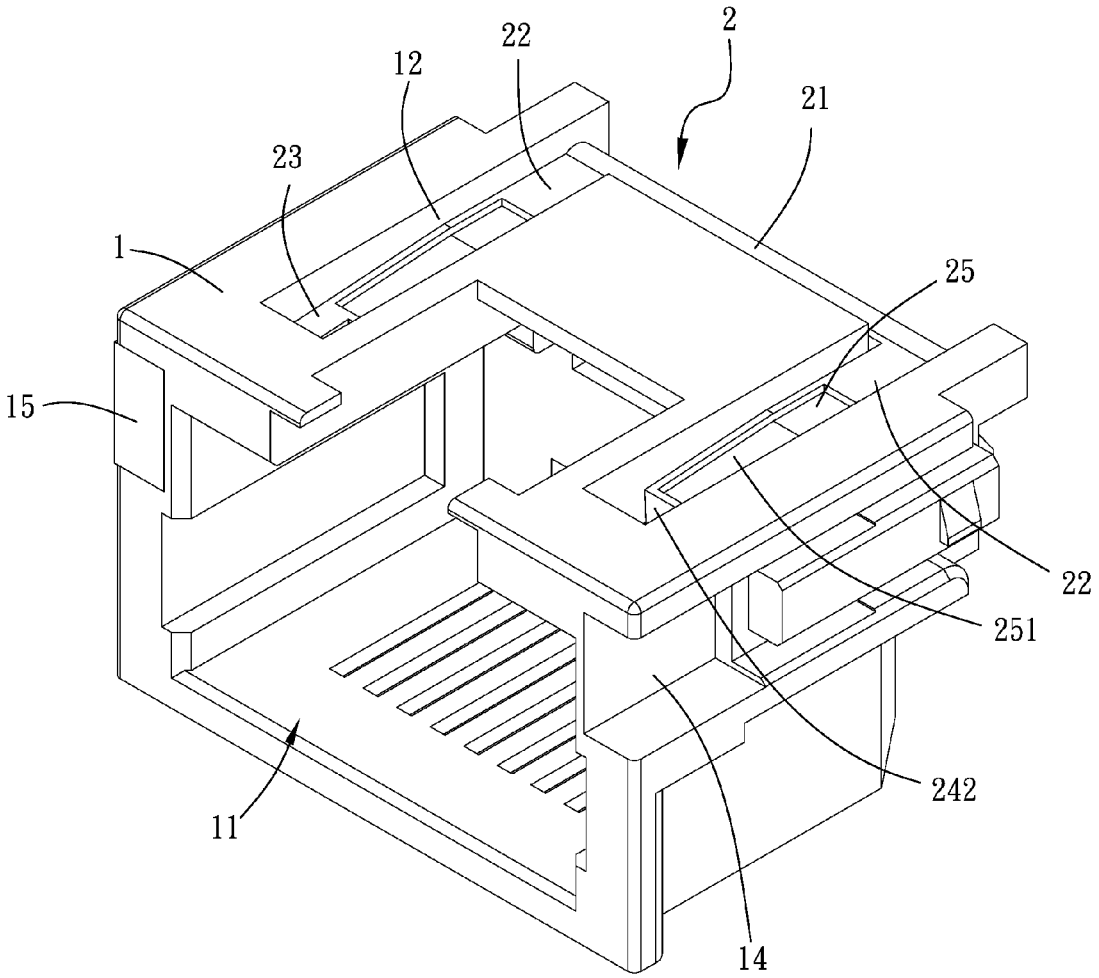
FIG. 6 is a perspective view of an anti-misinsertion component combined with an insulating base in accordance with the present invention.

When the socket connector of the present invention is assembled, the anti-misinsertion component 2 is passed in an opposite direction into the clasp slot 12 of the insulating base 1, and both ends of the pivot 21 of the anti-misinsertion component 2 are clasped into the clasp hole 13 of the insulating base 1, so that the two connecting arms 22 of the anti-misinsertion component 2 are contained in the clasp slot 12 of the insulating base 1 as shown in FIG. 6, wherein a bottom surface 222 of the connecting arms 22 abuts the stop block 121 disposed in the clasp slot 12, and then light emitting diodes 15 are embedded into narrow grooves 14 formed on two sidewalls of the insulating base 1 respectively, and the conductive terminals 4 are placed into the docking space 11 of the insulating base 1, and the shielding casing 3 is covered onto the external periphery of the insulating base 1, and the plug hole 31 of the shielding casing 3 is aligned precisely with the docking space 11 of the insulating base 1, and the two elastic plates 32 installed at the top surface of the shielding casing 3 abut the abutment bevel 251 of the connecting arm 22, and the two connecting arms 22 of the anti-misinsertion component 2 are compressed downward and bent by the force of the two elastic plates 32, so that the guide piece 23 and the stop piece 24 installed at the front end of the connecting arm 22 are passed downwardly out from the clasp slot 12 of the insulating base 1 and situated in the docking space 11 of the insulating base 1, so as to complete assembling the socket connector of the present invention.

Figure 7A:
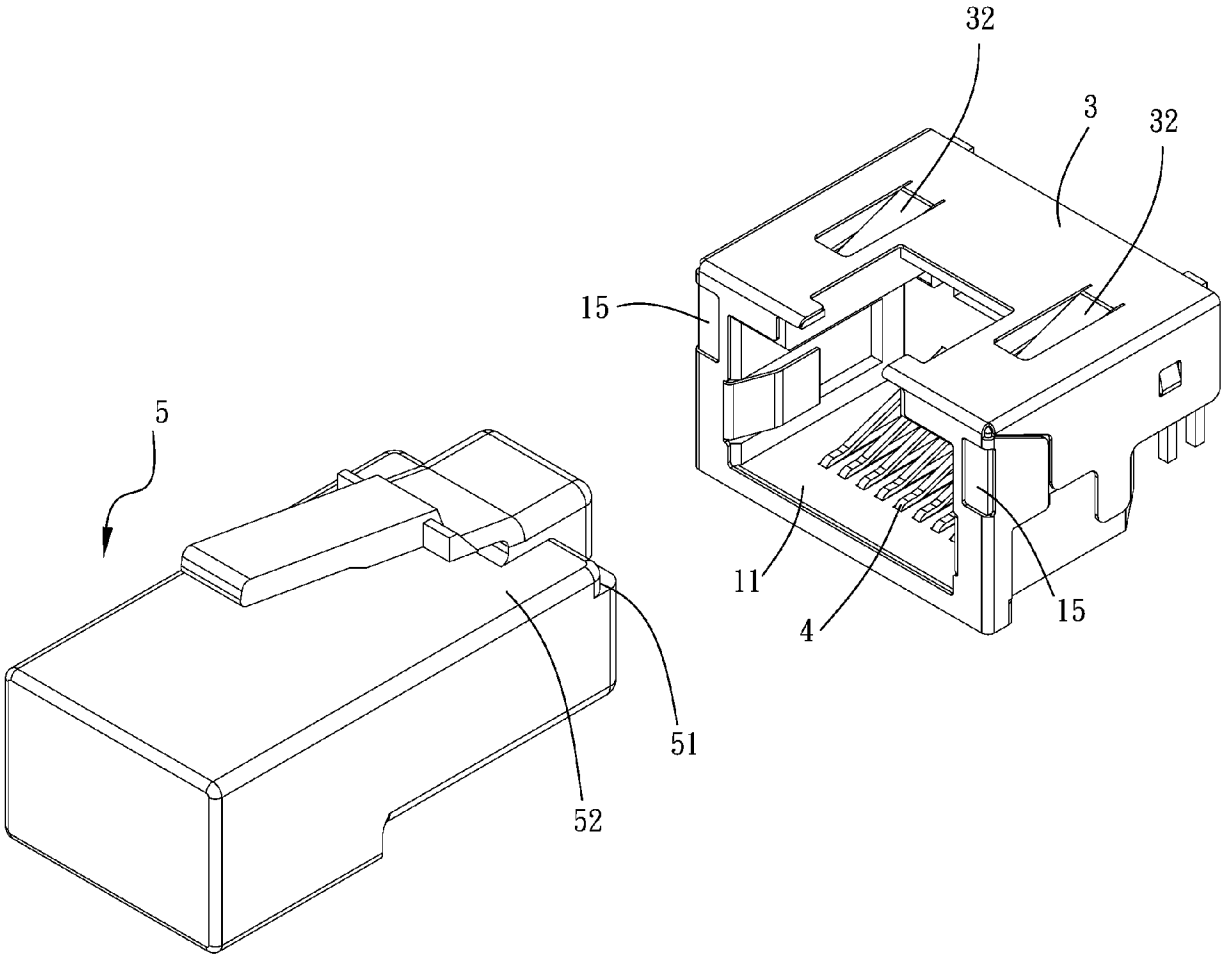
FIG. 7A is a schematic view of a socket connector and a plug connector of the present invention before they are connected.
Figure 7C:
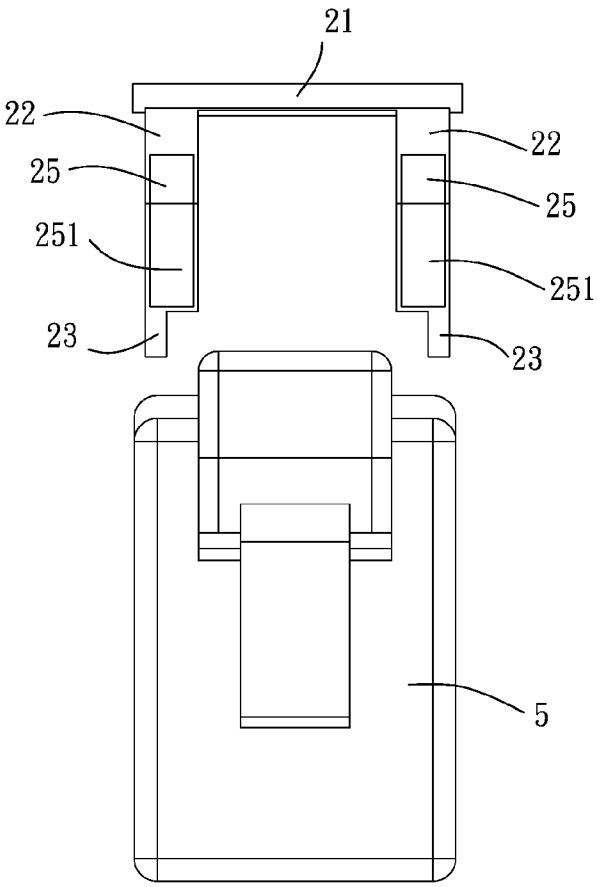
FIG. 7C is a schematic view of a socket connector and a plug connector of the present invention before and after they are connected.
Figure 7B:
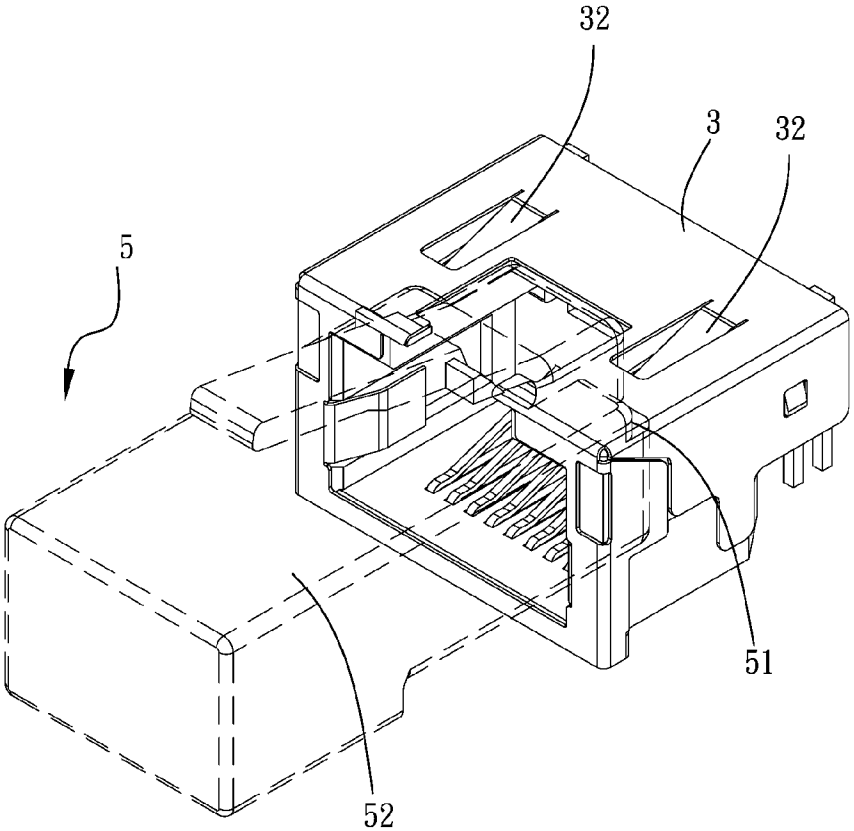
FIG. 7B is a schematic view of a socket connector and a plug connector of the present invention while they are being connected.

With reference to FIGS. 7A to 7C, when a default plug connector 5 (such as the RJ-45 plug connector) is inserted into the docking space 11 of the insulating base 1, the width of the plug connector 5 is greater than the width of the anti-misinsertion component 2, so that the end surfaces 51 on both sides of the plug connector 5 are in contact with the first guide bevel 231 at the bottom surface of the guide piece 23 of the anti-misinsertion component 2. When the plug connector 5 keeps moving forward, the end surfaces 51 of the plug connector 5 push the first guide bevel 231, so that the guide piece 23 drives the connecting arm 22 to move upward, and the abutment bevel 251 of the connecting arm 22 pushes the elastic plate 32 of the shielding casing 3 upward. Since the connecting arm 22 moves upward, the plug connector 5 can be inserted into the docking space 11 of the insulating base 1 successfully to form an electric connection between the conductive terminals 4 of the insulating base 1.

Wherein, the connecting arm 22 is pushed by the plug connector 5 to move upward, so that the abutment bevel 251 of the connecting arm 22 abuts the elastic plate 32 of the shielding casing 3 to prevent the elastic plate 32 from protruding upwardly out from the shielding casing 3, and the elastic plate 32 abuts the abutment bevel 251, so as to prevent the anti-misinsertion component 2 from being retracted by external forces. In addition, the pivot 21 is movably clasped into the clasp hole 13 of the insulating base 1 and the stop block 121 of the insulating base 1 abuts the bottom surface 222 of the connecting arm 22 to position the anti-misinsertion component 2 into clasp slot 12 in order to prevent the anti-misinsertion component 2 from being separated from the clasp slot 12 by the compression from the plug connector 5, 6 and the elastic plate 32.

In addition, when a user want to unplug the plug connector 5 from the docking space 11 of the insulating base 1, the top surface 52 of the plug connector 5 presses the second guide bevel 241 of the stop piece 24 to drive the stop piece 24 to move the connecting arm 22 upward, so that the plug connector 5 can be unplugged from the docking space 11 of the insulating base 1 successfully. After the plug connector 5 is separated from the docking space 11, the position-restoring elasticity of the elastic plate 32 presses the elastic plate 32 against the connecting arm 22 to position the anti-misinsertion component 2 into the clasp slot 12.

Figure 8A:
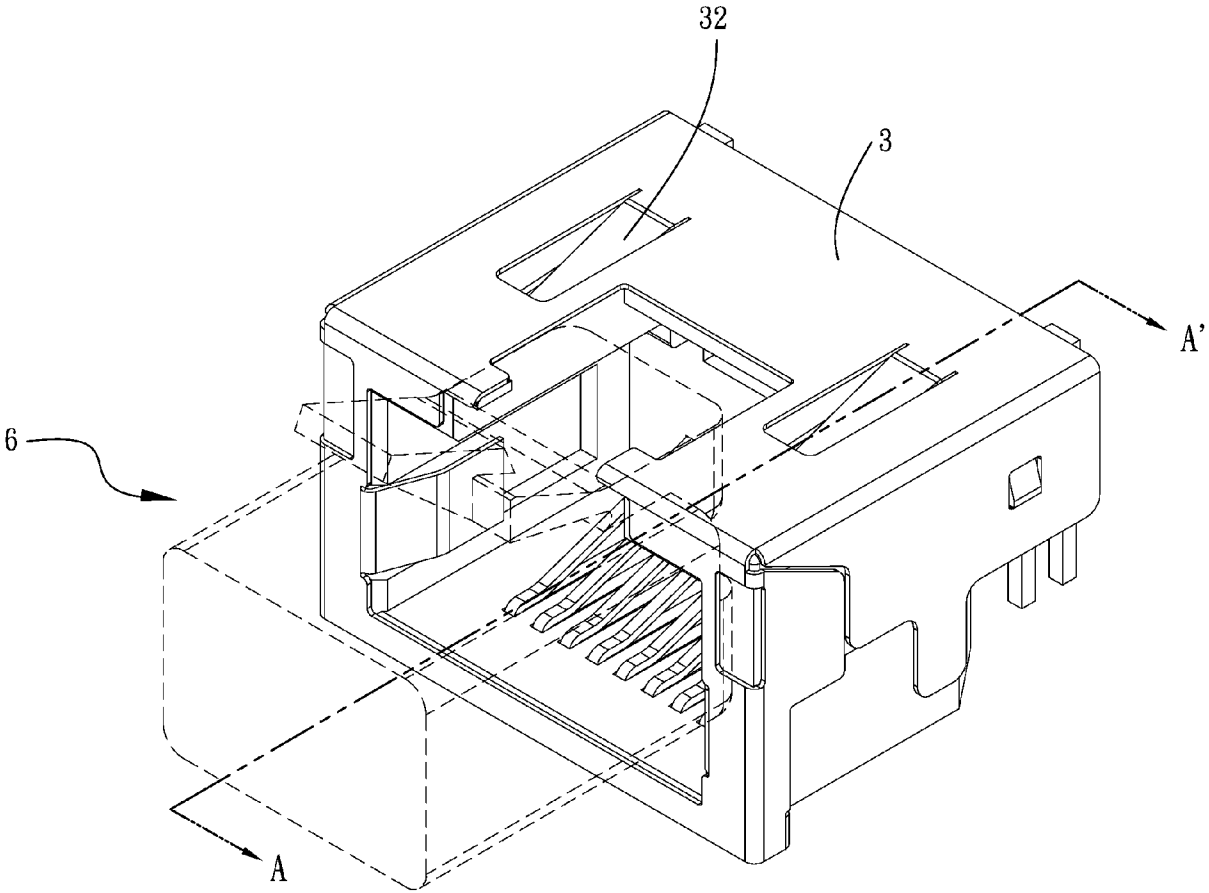
FIG. 8A is a schematic view of a socket connector and a RJ-11 plug connector of the present invention while they are being connected.
Figure 8C:
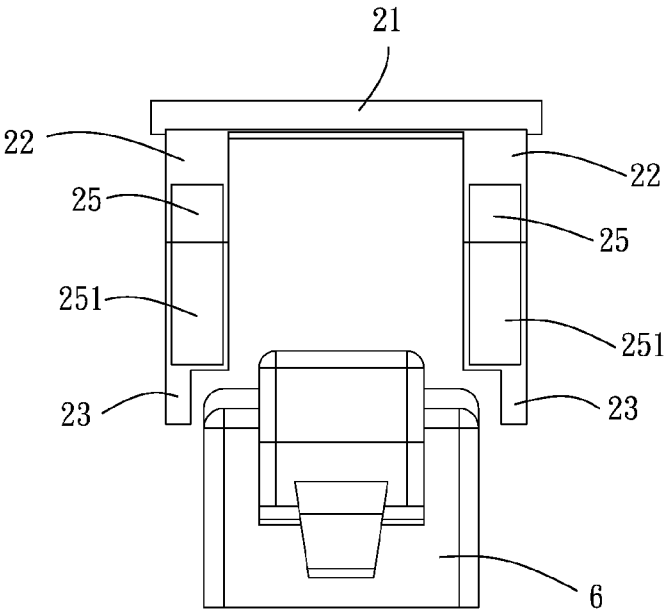
FIG. 8C is a schematic view of a socket connector and a RJ-11 plug connector of the present invention before and after they are connected.
Figure 8B:
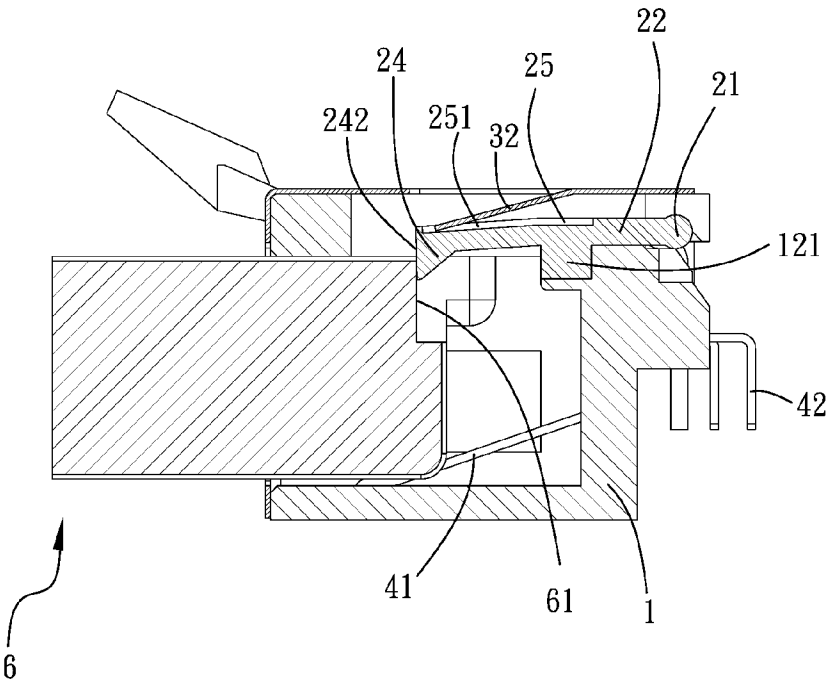
FIG. 8B is a cross-sectional view of Section A-A' of FIG. 8A.

With reference to FIGS. 8A to 8C, when a non-adaptive plug connector 6 (such as the RJ-11 plug connector) is inserted into the docking space 11 of the insulating base 1, the width of the plug connector 6 is smaller than the interval between the two guide pieces 23 of the anti-misinsertion component 2, so that the end surfaces 61 on both sides of the plug connector 6 are blocked by the stop surface 242 of the stop piece 24, and the plug connector 6 can no longer be pushed into the docking space 11, and the plug connector 6 is restricted in a space formed by the two guide pieces 23 and the two stop pieces 24 by the stop surface 242 of the stop piece 24 and the position limit surface 232 of the guide piece 23, so as to prevent users from inserting a smaller plug connector 6 into the docking space 11 of the insulating base 1 by mistake, and achieve the effects of preventing a mis-insertion of a non-adaptive plug connector and protecting the conductive terminals of the socket connector.

In summation of the description of the above, the present invention can achieve the expected objectives and guide the default plug connector into the socket connector by the guide bevel of the connecting arm and the stop surface and prevent an insertion of a non-adaptive plug connector, and further uses the pivot of the connecting arm and the stop block of the insulating base to position the anti-misinsertion component in the clasp slot, so as to achieve the effects of preventing a mis-insertion of a non-adaptive plug connector and protecting the conductive terminals of the socket connector. Obviously, the present invention complies with patent application requirements, and thus is duly filed for patent application.

While the invention has been described by means of specific embodiments, numerous modifications and variations could be made thereto by those skilled in the art without departing from the scope and spirit of the invention set forth in the claims.

What is claimed is:

1. An anti-misinsertion structure of a socket connector, comprising:

a pivot, movably clasped to both sides of the top of an insulating base of the socket connector; and two connecting arms, extended horizontally and respectively from both sides of the pivot, and having a guide piece horizontally extended from an end of each connecting arm, a stop piece formed at a bottom of each of the connecting arms and proximate to the guide piece of the connecting arm, wherein a downwardly tilted first guide bevel is formed at a bottom of the guide piece, a position limit surface is defined on a side of the guide piece and proximate to the stop piece, and an upwardly tilted second guide bevel is formed at a bottom of the stop piece, and a stop surface is defined on a side of the stop piece and proximate to the guide piece, and the stop surface is perpendicular to the position limit surface of the guide piece, in addition, the connecting arms have a recessed portion disposed at the top of the connecting arms, and the recessed portion has an abutment bevel formed at an end of recessed portion and proximate to the stop piece.

2. The anti-misinsertion structure of a socket connector according to claim 1, wherein the connecting arms have a protruding block formed at an end of the connecting arms and proximate to the pivot.

3. A socket connector, comprising:

an insulating base, having a docking space for inserting a plug connector, a plurality of conductive terminals installed in the docking space, and a clasp slot formed on both sides of a top of the insulating base and interconnected to the docking space;

an anti-misinsertion component, having a pivot and two connecting arms extended respectively and horizontally from both sides of the pivot, wherein the connecting arms have a guide piece extended horizontally from an end of the connecting arms, the connecting arm, and a stop piece formed at a bottom of each of the connecting arms and proximate to the guide piece of the connecting arm, in addition, the connecting arm of the anti-misinsertion component has a recessed portion formed at the top of the connecting arm, and the recessed portion has an abutment bevel formed at an end of the recessed portion and proximate to the stop piece; and a shielding casing, covered onto an external periphery of the insulating base, and having a plug hole formed at a position opposite to the docking space of the insulating base, and an elastic plate installed separately on both sides of the top of the shielding casing; wherein, the anti-misinsertion component is installed in the clasp slot of the insulating base, and the elastic plate of the shielding casing abuts the abutment bevel of the recessed portion, so that the anti-misinsertion component is capable of preventing a plug connector of a different specification from being inserted into the docking space.

4. The socket connector according to claim 3, wherein the clasp slot of the insulating base has a stop block disposed therein, and the stop block is stopped at an end of the connecting arm of the anti-misinsertion component and proximate to the pivot.

5. The socket connector according to claim 3, wherein the clasp slot of the insulating base has a clasp hole formed therein for clasping the pivot of the anti-misinsertion component.

6. The socket connector according to claim 3, wherein the guide piece of the anti-misinsertion component has a downwardly tilted first guide bevel defined on a bottom surface of the guide piece.

7. The socket connector according to claim 3, wherein the guide piece of the anti-misinsertion component has a position limit surface defined on a side of the anti-misinsertion component and proximate to the stop piece, and the position limit surface and the stop piece are perpendicular to each other.

8. The socket connector according to claim 3, wherein the stop piece of the anti-misinsertion component has an upwardly tilted second guide bevel defined on a bottom surface of the stop piece.

9. The socket connector according to claim 3, wherein the stop piece of the anti-misinsertion component has a stop surface defined at a side of the stop piece and proximate to the guide piece, and the stop surface and the guide piece are perpendicular to each other.

10. The socket connector according to claim 4, wherein the connecting arm of the anti-misinsertion component has a protruding block formed at a bottom surface of the connecting arm and proximate to the pivot.

* * * * *